US006482253B1

(12) United States Patent
Dunn

(10) Patent No.: US 6,482,253 B1
(45) Date of Patent: Nov. 19, 2002

(54) POWDER CHARGING APPARATUS

(76) Inventor: John P. Dunn, 147 W. Gray St., Apartment 508, Elmira, NY (US) 14901

( * ) Notice: Subject to any disclaimer, the term of this patent is extended or adjusted under 35 U.S.C. 154(b) by 0 days.

(21) Appl. No.: 09/675,848

(22) Filed: Sep. 28, 2000

Related U.S. Application Data

(60) Provisional application No. 60/156,680, filed on Sep. 29, 1999.

(51) Int. Cl.[7] ..... B03C 3/36

(52) U.S. Cl. ..... 96/62; 55/DIG. 38; 95/78; 96/32; 96/73; 96/99

(58) Field of Search ..... 96/60, 62, 73, 96/50, 97–99, 32; 95/78; 55/DIG. 25, DIG. 38

(56) References Cited

U.S. PATENT DOCUMENTS

| | | | | | |
|---|---|---|---|---|---|
| 2,195,431 | A | * | 4/1940 | Shively et al. | 96/97 X |
| 2,454,757 | A | | 11/1948 | Smith | 95/71 X |
| 3,365,858 | A | * | 1/1968 | Penney | 96/73 X |
| 3,633,337 | A | | 1/1972 | Walker et al. | 95/80 |
| 3,795,605 | A | * | 3/1974 | Candor | 96/60 X |
| 3,826,063 | A | * | 7/1974 | Festner | 55/DIG. 25 |
| 4,117,255 | A | * | 9/1978 | Kawaike et al. | 96/50 |
| 4,670,026 | A | * | 6/1987 | Hoenig | 96/97 X |
| 4,734,105 | A | * | 3/1988 | Eliasson et al. | 96/97 X |
| 4,812,711 | A | | 3/1989 | Torok et al. | 261/DIG. 42 |
| 4,967,119 | A | | 10/1990 | Torok et al. | 261/DIG. 42 |
| 5,006,761 | A | | 4/1991 | Torok et al. | 261/DIG. 42 |
| 5,199,257 | A | * | 4/1993 | Colletta et al. | 96/97 X |
| 5,591,258 | A | | 1/1997 | Altman et al. | 95/78 X |
| 5,667,563 | A | * | 9/1997 | Silva, Jr. | 96/97 X |
| 5,683,494 | A | | 11/1997 | Altman et al. | 96/55 |
| 5,707,428 | A | | 1/1998 | Feldman | 96/60 X |
| 5,824,137 | A | * | 10/1998 | Gutsch et al. | 95/78 X |
| 6,017,381 | A | * | 1/2000 | Dunn et al. | 95/78 X |

FOREIGN PATENT DOCUMENTS

| | | | | |
|---|---|---|---|---|
| JP | 6-165949 | * | 6/1994 | 96/97 |
| SU | 668707 | * | 6/1979 | 96/97 |

* cited by examiner

*Primary Examiner*—Richard L. Chiesa
(74) *Attorney, Agent, or Firm*—Brown & Michaels, PC

(57) ABSTRACT

This invention relates to an apparatus and method to electrostatically charge or neutralize particles conveyed in a pneumatic stream. More particularly the invention is drawn to an apparatus that has at least two longitudinal chambers separated from each other with a plate electrode. Within each chamber is at least one corona charging electrode with multiple discharge points and at least one power level zone. The apparatus divides a single gas stream into a multiple streams where corona discharge polarizes or neutralizes particles with a similar or dissimilar polarity causing coalescing or separation of the particles as they exit the charging chambers.

11 Claims, 6 Drawing Sheets

POWDER CHARGING APPARATUS

REFERENCE TO RELATED APPLICATIONS

This application claims an invention which was disclosed in Provisional Application No. 60/156,680, filed Sep. 29, 1999, entitled "ELECTRICAL CHARGING APPARATUS AND METHOD USED TO POLARIZE OR NEUTRALIZE PARTICLES OF POWDER". The benefit under 35 USC §119(e) of the United States provisional application is hereby claimed, and the aforementioned application is hereby incorporated herein by reference.

FIELD OF THE INVENTION

This invention relates to an apparatus and method to electrostatically charge or neutralize particles conveyed in a pneumatic system. More particularly, the apparatus divides a single gas stream into a multiple several divided streams and charging and polarizing the particles with a high intensity corona discharge. This results in either neutralizing or charging particles with either similar or dissimilar polarities. These particles can be attracted and coalesced into larger particles or separated by repulsion as the particles exit the chambers. Streams with a dissimilar polarity cause the coalescing by attraction as the particles exit the charging chambers.

BACKGROUND OF INVENTION

The pneumatic conveying of powders is used extensively throughout the processing industry. Most of the efforts are spent on neutralizing the charge on particles in order prevent the powders from forming hard clusters and agglomerates that interfere with the flow or cause plugging. In other more serious situations, the accumulation of excessive charges can result in the release of destructive energies.

U.S. Pat. No. 6,017,381 to present inventor shows a cyclone apparatus. With this apparatus there became a need to improve the collection and separation of fine particles. This can be resolved by controlling the charge on the particles entering the cyclone thereby improving the collection efficiency. Particles entering the cyclone are normally triboelectrically charged to varying intensities and with varying polarities. The varying charge conditions can result from either previous or existing process or operating parameters. Another way to vary the charging conditions is through there being differences between the electrical properties of the powder and the construction materials. These variables result in an uncontrolled process with unpredictable collection efficiencies.

In addition, it was found that it is necessary to have the plate and charging electrodes in close proximity to each other in order to improve the ability of ions to follow the flux lines and attach themselves to the entrained particles. Large distances between electrodes and the variation of the particles concentration in the entrained flow can result in the reduced probability of ion to particle attachment. This requires more exposure time to achieve a full charge and larger equipment. Efforts made to understand and control this pre-charging process resulted in the present invention.

SUMMARY OF INVENTION

The method and apparatus of the present invention electrically charges aerosol and solid particles in a gas stream by dividing and separating a single pneumatic gas/solid stream into two or more streams. The stream is directed into a multiple number of parallel charging sections and exiting back into a single stream. Three electrical states are possible, neutral, attraction, and repulsion.

Particles leaving the multiple charging sections flow into additional processing chambers where the particles can coalesce or be neutralized. Coalescing or the agglomeration of particles takes place when opposing chambers are at different polarity and particles emerge from the respective chambers and inter-react. This can lead to small particles reacting with each other to form larger particles or small particles attaching to large particles to form even larger particles.

Neutralization of particles occurs by using AC corona emission in each chamber. The purpose of neutralizing particles is to prevent clumping or the formation of large clusters of powder that interfere with the flow of materials in a process or pneumatic conveying system. Neutralization can occur in the process of coalescing powders when most of the particles reach a neutral state after they combine, providing the ratio of charge state for the particles are equal.

Repulsion is used to prevent the formation of clusters or larger particles. It is achieved when all of the particles exit the chambers having the same polarity.

The above technology has been used to improve the efficiency of a cyclone to collect fine particles by coalescing the particles before they enter a cyclone. It has also improved the operation efficiency of an electrical cyclone to either collect or separate dissimilar materials. This same technology could be used to improve the operation efficiency of an electrical precipitator to collect fine particles by coalescing particles prior entering a standard precipitator.

When neutralization is the primary requirement or a multi tube is desired, a single conduit composed of an outer dielectric cylinder with charging electrodes and a inner concentric cylinder electrode can be used. Both the multi chamber and concentric tube designs use the same basic technology.

DETAILED DESCRIPTION OF INVENTION

The present invention relates to methods and apparatus for charging powders using either a direct current or an alternating high voltage field along with a corona discharge to produce particles with a desired polarity. The apparatus consists of a single or multiple conduits that are divided into an even number of multiple chambers that can operate with each opposing chamber having either a different or similar polarity.

The process consists of entrained powder entering a divided conduit or duct system where they are electrically charged and polarized. Upon exiting the separate chambers, the individual polarized particles combine to form larger particles when the opposing chambers have different polarities. If the polarities were similar in each chamber the particles leaving the chambers would continue in a repelled state until they lose their charge by contact, triboelectric conditions or normal charge decay. If the entrained particles entering the conduit were previously charged and then were subjected to a high voltage alternating current ion discharge, the particles would lose their polarity and be in neutralized state as they exit the chamber.

Figure 1B:
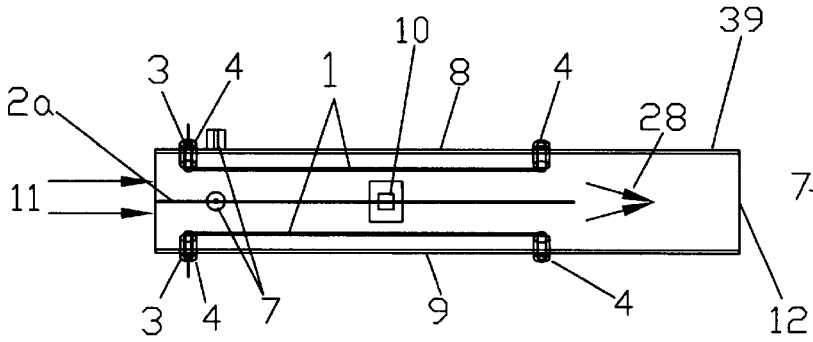
FIG. 1B is schematic showing an elevation view of a tubular charger with two individual chambers, four charging electrodes, and a single plate electrode.
Figure 1A:
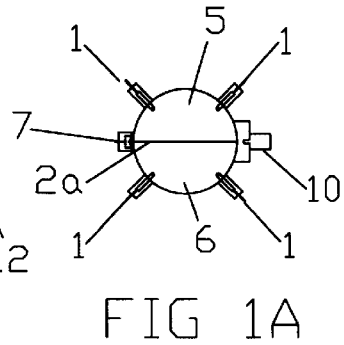
FIG. 1A is a schematic showing a cross sectional view of a tubular charger with two individual chambers, four charging electrodes, and a single plate electrode.
Figure 10:
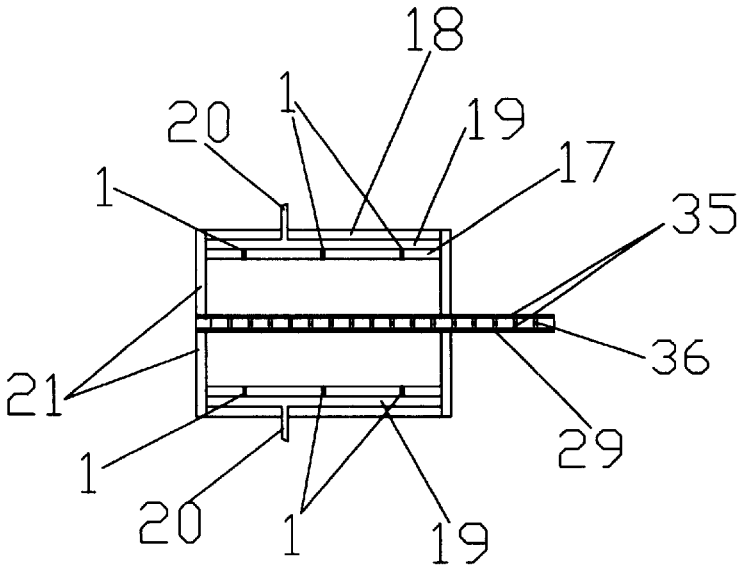
FIG.10 is a schematic showing a cross sectional view of a dual rectangular chamber particle charger with six charging electrodes, one laminated plate electrode.

One of the preferred constructions is illustrated in FIG. 1A and FIG. 1B, consisting of an dielectric conduit 39 system divided into two individual charging chambers 5 and 6 where the particles are charged by corona discharge emitting electrodes 1. The plate 2*a* that divides the conduit 39 into two chambers can be constructed of a conductive material. Alternatively, as seen in FIG. 10, the plate 2*a* can be a laminated structure 29 consisting of a conductive plate 36 covered with a dielectric material 35.

Particle charging takes place by dispersed powder passing through a high intensity corona discharge field 16, established between the corona electrodes 1 and a plate electrodes 2*a*. By varying the number discharge electrodes per chamber, the number of discharge points 38 per charging electrode and the relative short distance between the charging and plate electrodes, the probability of both the field and diffusion mechanisms for charging particles will be active. This results in a very efficient method for charging both large and fine particles.

One of the major advantages of using a high concentration of charging electrodes 1 and discharge points 38, is that the length of charging zone can be short and still produce a saturation of charges on the particles. The exposure time is important in preventing particles adhering to the plate electrode 2*a*. When low air velocities are required, rapping or vibration mechanism 10 are used to prevent particles from adhering to the charging electrodes.

Figure 2B:
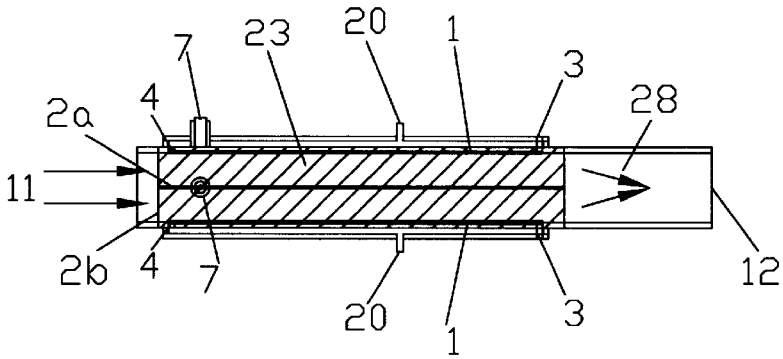
FIG. 2B is a schematic showing an elevation view of a tubular charger with four individual chambers, four charging electrodes, two 90 degree plate electrodes.
Figure 2A:
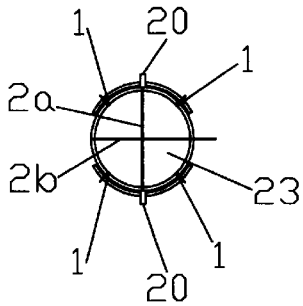
FIG. 2A is a schematic showing a cross sectional view of a tubular charger with- four individual chambers, four charging electrodes.

FIGS. 2A and 2B illustrate the concept of more then two chambers 23 within a single conduit. As the number of individual chambers increase, the concentration of powder per chamber is reduced resulting in an improved exposure of individual particles to the corona discharge.

Figure 3:
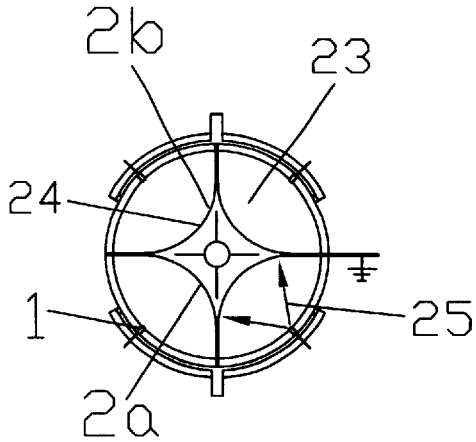
FIG. 3 is a schematic showing a cross sectional view of a tubular charger with four individual chambers, four charging electrodes, two 90 degree radii plate electrodes.

FIG. 3 shows a four chamber particle charger with radiuses extending from the dielectric conduit 39 that supports the charging electrode 1 to the plate electrodes 2*a* and 2*b*. The radius plate electrode 25 provide for a more uniform electric field between the charging electrode 1 and the plate electrode 2*a* and 2*b*. Having a radius in the plate electrodes 2*a* and 2*b* will also offer less resistance to flow then the 90 degree structure shown in FIG. 1B.

Figure 4A:
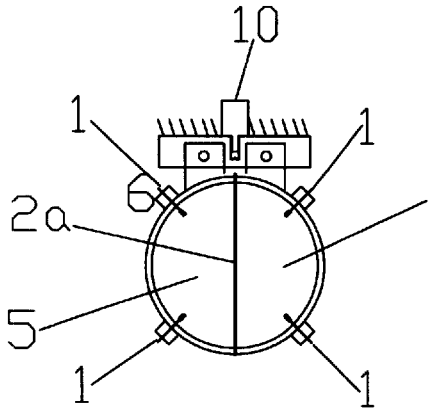
FIG. 4A is a schematic showing a cross sectional view of a tubular charger with two individual hinged chambers, four charging electrodes, and a one plate electrode.
Figure 4B:
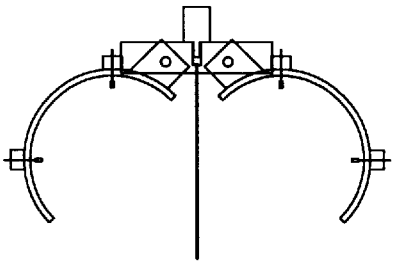
FIG. 4B is a schematic showing a cross sectional view of a tubular charger with two both hinged halves in an open position.

FIGS. 4A and 4B are cross sectional views illustrating a hinged two chamber charger designed specifically for ease of cleaning. FIG. 4A shows the operating position and FIG. 4B in the open, cleaning position.

Figure 5:
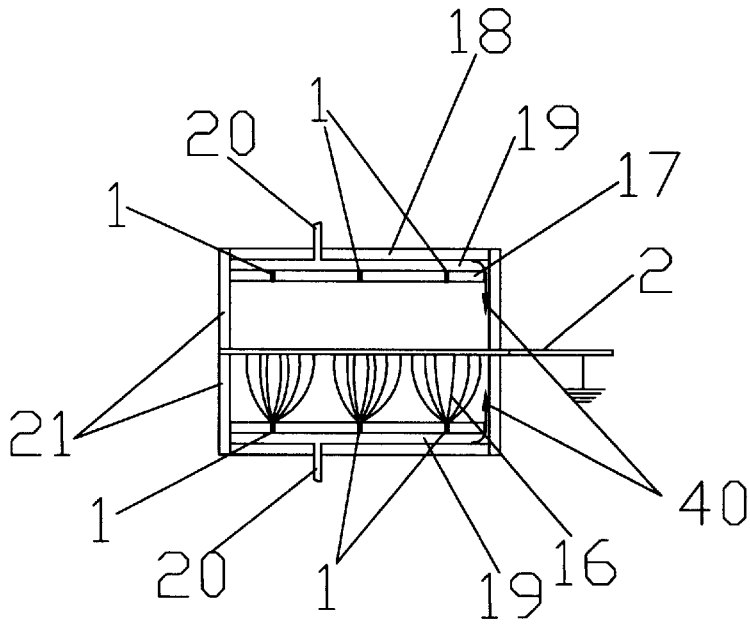
FIG. 5 is a schematic showing a cross sectional view of a of a dual rectangular chamber, six charging electrodes, one plate electrode.

FIG. 5 is a cross sectional view of a rectangular dielectric conduit 21 designed to provide a more uniform charge and field distribution 16 across the full width of the dielectric conduit 21. Another design feature found in the rectangular design is the ability to adjust the gap between the charging electrodes 1 and the plate electrode 2. This feature allows for varying the operating parameters to suit specific material and process requirements.

Figure 6:
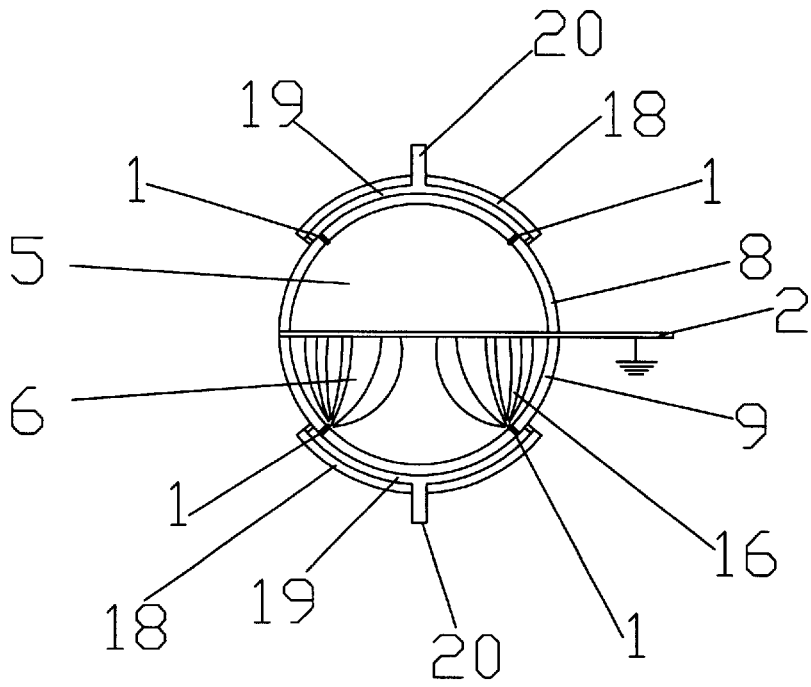
FIG. 6 is a schematic showing a cross sectional view of a of a dual cylindrical chamber, six charging electrodes, one plate electrode.
Figure 7:
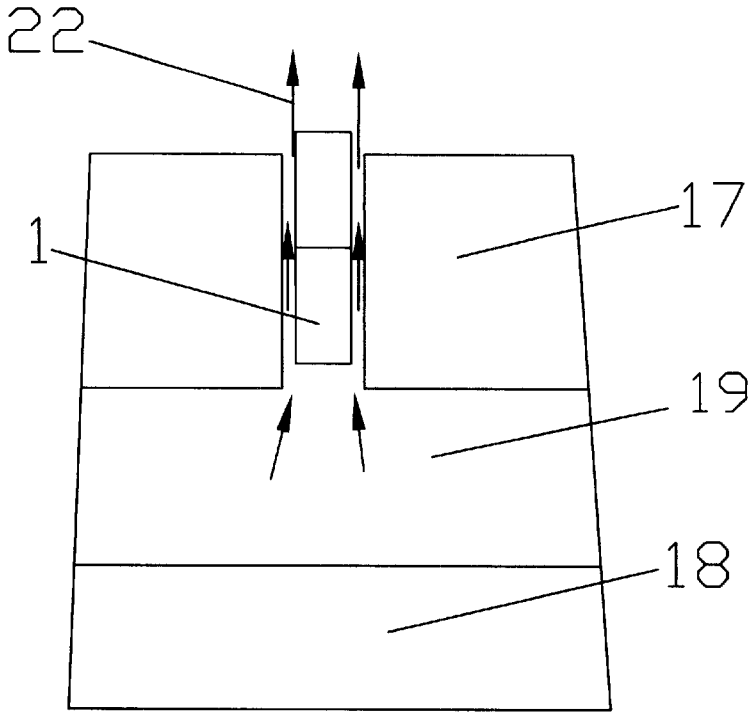
FIG. 7 is an enlarged schematic showing the flow of purging gas used to clean the corona charging electrode.
Figure 12:
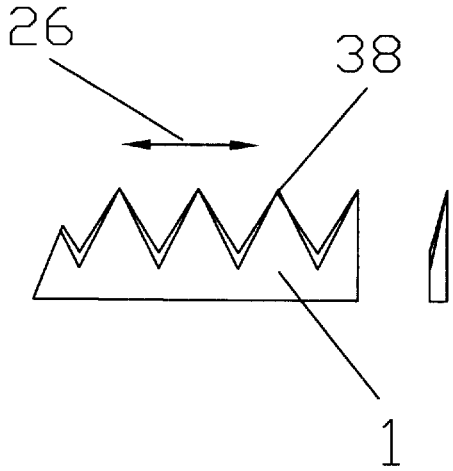
FIG. 12 illustrates one type of charging electrode and defines the difference between charging electrode and discharge points.

Also shown in FIG. 5, a means is provided for keeping the charging electrode 1 clean when processing powders at low velocities and in the lower micron range, <5 at 50 percentile. A preferred method is shown in FIG. 5 and FIG. 6 where a purging gas 22, as seen in FIG. 7, is periodically passed between the walls of the inner dielectric conduit 17 and the outer conduit or plate 18. The gas exits between the charging electrodes 1 and the support 17. FIG. 5 also shows an air purge 40 method used to keep the side support walls of the rectangular charger clean. This is considered essential when processing conductive materials. A rapping device 10 has also been used but has not proven to be as effective in keeping the plate electrodes clean when processing some materials.

Figure 8:
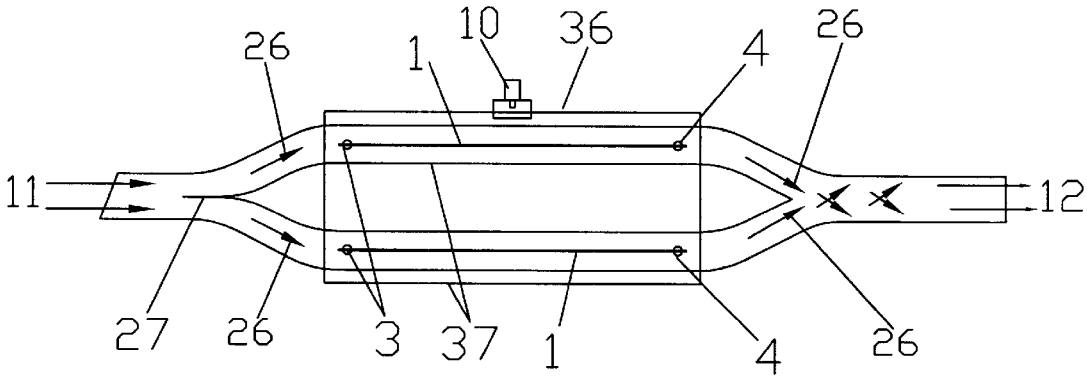
FIG. 8 is a schematic showing a plan view of a single input, dual conduit with each tube divided in half by a plate electrode and a converging single exit.

FIG. 8 show another preferred embodiment schematic showing a plan view of a single input 11, output 12, dual conduit tube chargers 37. The entrained particles enter at 11 and can be directed to flow in only one conduit or both by movement of the deflector plate 27. The purpose of this design is to offer a bypass system for maintenance where one conduit can be removed while the other continues to operate.

Figure 9:
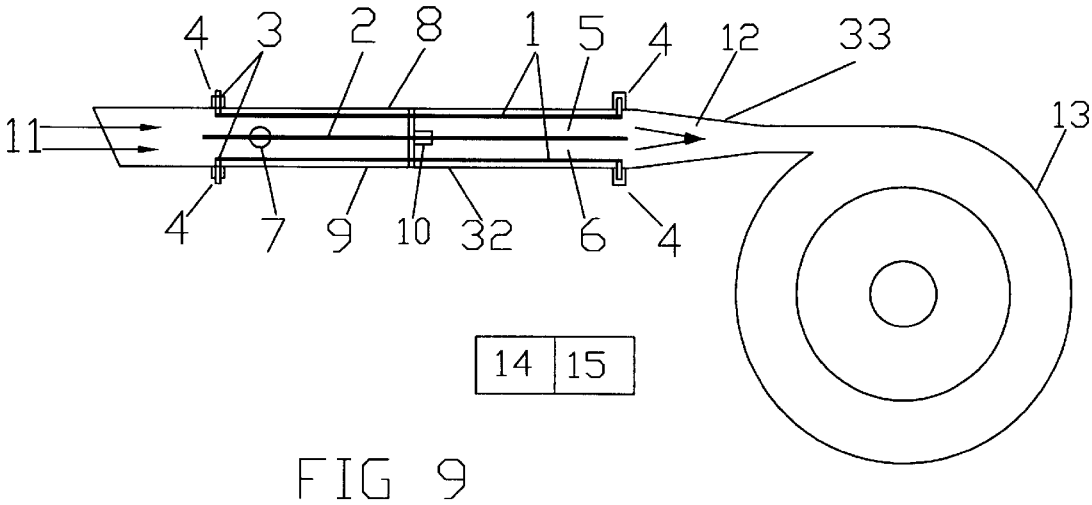
FIG. 9 is a schematic plan view of a preferred application of the invention showing a solid/gas entrained cyclone system using a single input, divided dual chamber pre-charger and particle coalescing zone.

FIG. 9 is a schematic plan view showing a complete solid/gas entrained cyclone 13 flow system. The system includes a single input zone 11, with a divided chamber pre-charger 32 and a cyclone input duct 33, where particles coalesce, mix or remain in suspension and the cyclone 13. Plate electrode 2*a* is usually connected to ground via connection 7. Two power supplies 14 and 15 are connected one each to the charging electrodes of opposite chambers. If both chambers were the same polarity, only one power supply would be needed. With two power supplies, one chamber can be positive and the other chamber negative.

FIG. 10 is a cross sectional view of a dual rectangular chamber particle charger that uses a laminated plate electrode 29. The laminated plate electrode 29, is composed of a dielectric film or sheet 35, on each side of a conductive plate 36. Selection as to whether to use a solid conductive or laminated plate is based on the electrical and mechanical properties of the powder being processed. Conductive metal particles tend to be repelled from a conductive plate 2a, but adhere to the dielectric laminated plate 29.

Figure 11:
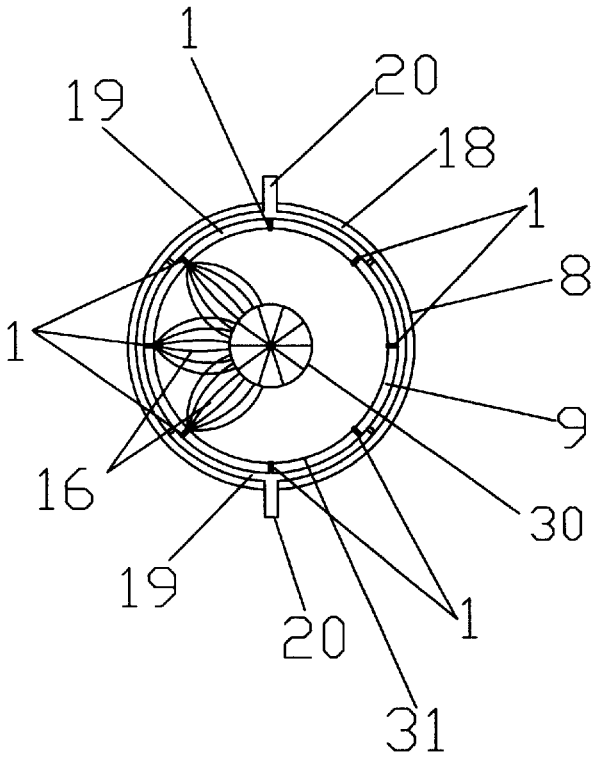
FIG. 11 is a schematic showing a cross sectional view of concentric cylinder particle charger composed of a grounded central cylindrical electrode, a single circular chamber, eight charging electrodes.

FIG. 11 is a cross sectional view of a concentric cylinder particle charger composed of: a grounded central cylindrical electrode 30, outer cylindrical conduit that supports the charging electrodes, eight charging electrodes 1 and a pneumatic method for maintaining clean charging electrodes. A pneumatic method can also be used to keep the central cylinder electrode 30 by using a porous tube as opposed to a solid cylinder. Air under pressure can be pulsed at a rate that will maintain a relatively clean surface. The purpose of this design is to efficiently produce a single polarity or more specifically, neutral particles. However if used as a two conduits system, as seen in FIG. 8, it can function as a dual polarity apparatus. The features that make this design efficient are the uniform electrical field and the flow of ions across and perpendicular to the flow of the entrained air stream.

What I claim as my invention is:

1. A powder charging apparatus comprising:

an outer conduit having an inner and outer surface, said conduit providing an enclosed space having open ends;

at least one charging electrode positioned along said inner and outer surfaces; at least one plate electrode positioned longitudinally within said conduit and extending completely across said enclosed space; said conduit being divided into at least two charging chambers by said at least one plate electrode, said chambers forming charging zones for charging powder entrained in an air stream;

said conduit also having coalescing and mixing zones along its length; and a high voltage power supply connected to said at least one charging electrode whereby said power supply charges said at least one charging electrode which in turn charges said entrained powder.

2. The apparatus of claim 1, wherein said conduit is rectangular in cross-section.

3. The apparatus of claim 2, wherein said rectangular cross-section has sides and an air purging mechanism positioned adjacent said sides to keep the sides of the rectangular cross-section clean.

4. The apparatus of claim 1, wherein said at least one plate electrode divides a single air stream into multiple air streams which enter said at least two charging chambers.

5. The apparatus of claim 1, wherein a rapping device is connected to said at least one plate electrode to aid in keeping said at least one plate electrode clean during charging.

6. The apparatus of claim 1, wherein said conduit is circular in cross-section thereby forming a cylindrical shape.

7. The apparatus of claim 6, wherein said at least one plate electrode divides a single air stream into multiple air streams which enter said at least two charging chambers.

8. The apparatus of claim 6, wherein a rapping device is connected to said at least one plate electrode to aid in keeping said at least one plate electrode clean during charging.

9. The apparatus of claim 1, wherein said at least one plate electrode is a laminated plate, said laminated plate comprising: a conductive main plate having a dielectric material attached to each side.

10. The apparatus of claim 1, wherein said conduit is hinged along its length to facilitate cleaning.

11. The apparatus of claim 6, wherein said at least one plate electrode is a radiused plate electrode.

* * * * *